US005864912A

United States Patent [19]

Zhadanov

[11] Patent Number: 5,864,912

[45] Date of Patent: Feb. 2, 1999

[54] CLEANING DEVICE

[76] Inventor: Eli Zhadanov, 2944 W. 5th St., Brooklyn, N.Y. 11224

[21] Appl. No.: 735,330

[22] Filed: Oct. 22, 1996

[51] Int. Cl.[6] ..... A46B 13/06

[52] U.S. Cl. ..... 15/24; 15/29

[58] Field of Search ..... 15/24, 29; 239/214, 239/222, 222.11, 251

[56] References Cited

U.S. PATENT DOCUMENTS

| | | | |
|---|---|---|---|
| 3,605,154 | 9/1971 | Dawkins | 15/24 |
| 4,177,532 | 12/1979 | Azuma | 15/24 |
| 4,574,414 | 3/1986 | Zhadanov | 15/24 |

FOREIGN PATENT DOCUMENTS

| | | | |
|---|---|---|---|
| 546106 | 10/1922 | France | 15/24 |
| 3628668 | 3/1988 | Germany | 15/24 |

*Primary Examiner*—Randall E. Chin
*Attorney, Agent, or Firm*—Ilya Zborovsky

[57] ABSTRACT

A cleaning device has a housing, and a turbine drive located in the housing and rotatable under the action of water flowing into the housing, the turbine drive including two rotors connected with one another so that under the action of water flowing through the housing the rotors are rotated together.

13 Claims, 4 Drawing Sheets

CLEANING DEVICE

BACKGROUND OF THE INVENTION

The present invention relates to a cleaning device. More particularly, it relates to a cleaning device with a rotary tool rotatable by a turbine-like drive actuated by running water.

Cleaning devices of the above mentioned general type are known in the art. In known cleaning devices a rotor with inclined vanes creates a vortex under the action of water and through a gear transmission produces a torque so as to rotate a working tool. It is advisable to increase the power of the device as well as to reduce its size so that it can be used in household for showers, bathing units, kitchen units etc.

SUMMARY OF THE INVENTION

Accordingly, it is an object of present invention to provide a cleaning device of the above mentioned general type which is a further improvement of the existing cleaning devices.

In keeping with these objects and with others which will become apparent hereinafter, one feature of present invention resides, briefly stated, in a cleaning device which has a drive formed by at least two rotors connected with one another and jointly transmitting a torque to an output element on which a working tool can be mounted.

In the device in accordance with the present invention, the rotors are accelerated to high rotary speed, such as for example 3000–4000 revolutions per minute, and then the speed is reduced through a transmission to a minimum rotary speed required for performing the work so as to provide a maximum torque. This approach creates a very powerful tool which is at the same time compact, and can be used universally for applications from a shower to a powerful cleaning mechanical device. Also, the cleaning device can be used in conditions of low pressure of water systems.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
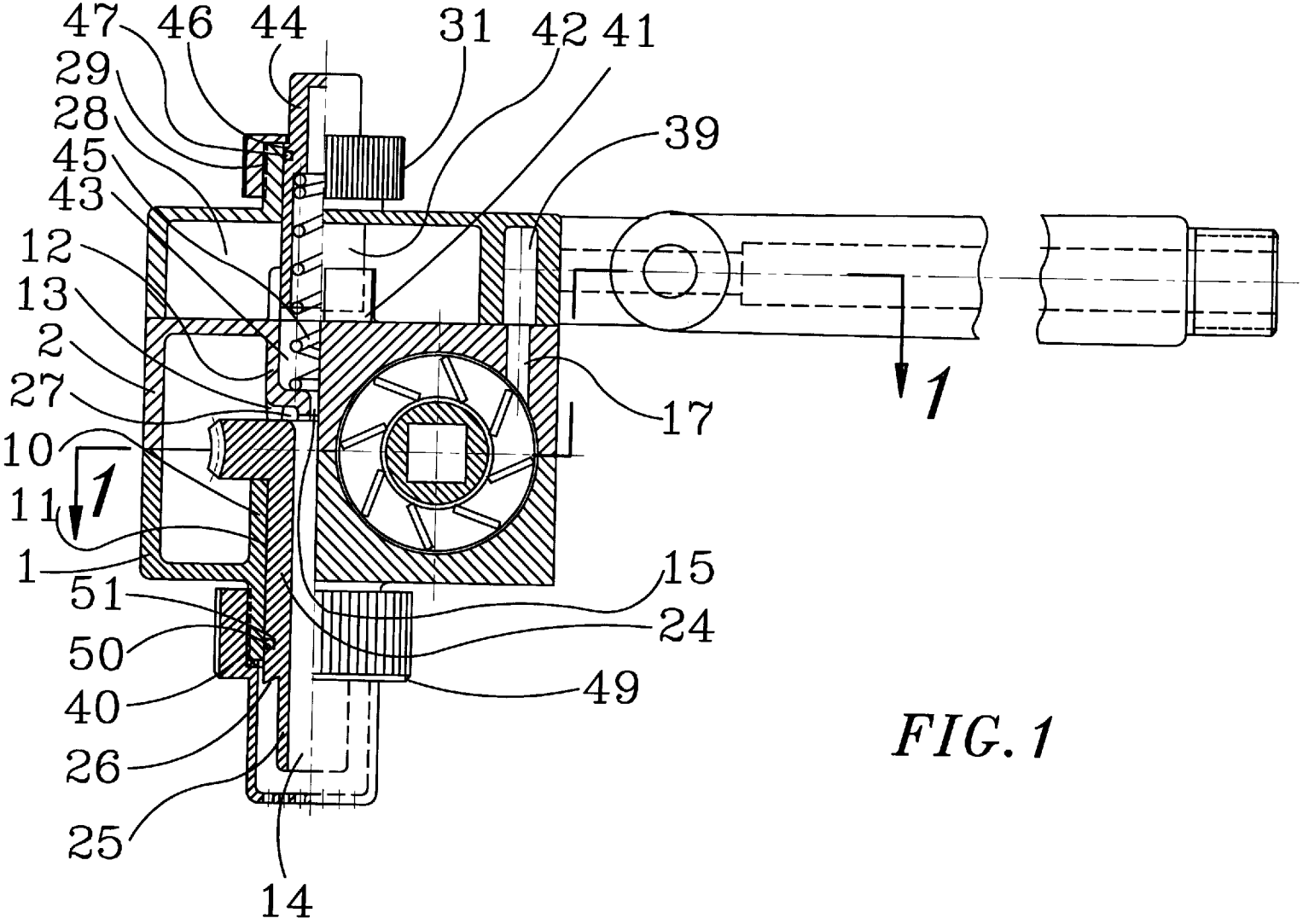
FIG. 1 is a view showing a section of a side view of the cleaning device in accordance with the present invention taken along the line 1—1 in FIG. 2.
Figure 2:
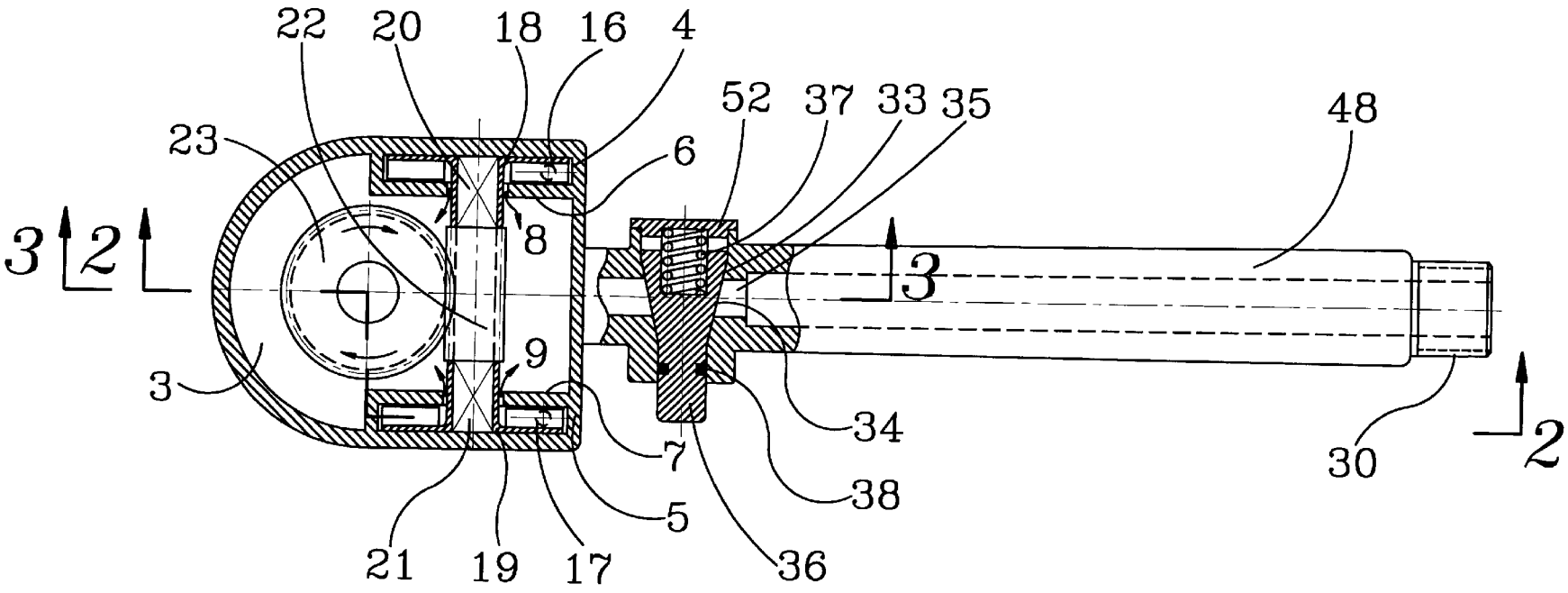
FIG. 2 is a plan view of the cleaning device in accordance with the present invention taken along the line 2—2 in FIG. 1.

A cleaning device in accordance with the present invention has a housing which includes a housing part 1 and a housing part 2 shown in FIGS. 1 and 2. The housing has a central chamber 3 and two side cylindrical chambers 4 and 5 separated from the central chamber by partitions 6 and 7. The housing parts are connected with one another and form the three chambers communicating with one another by openings 8 and 9 in the partitions 6 and 7.

Figure 3:
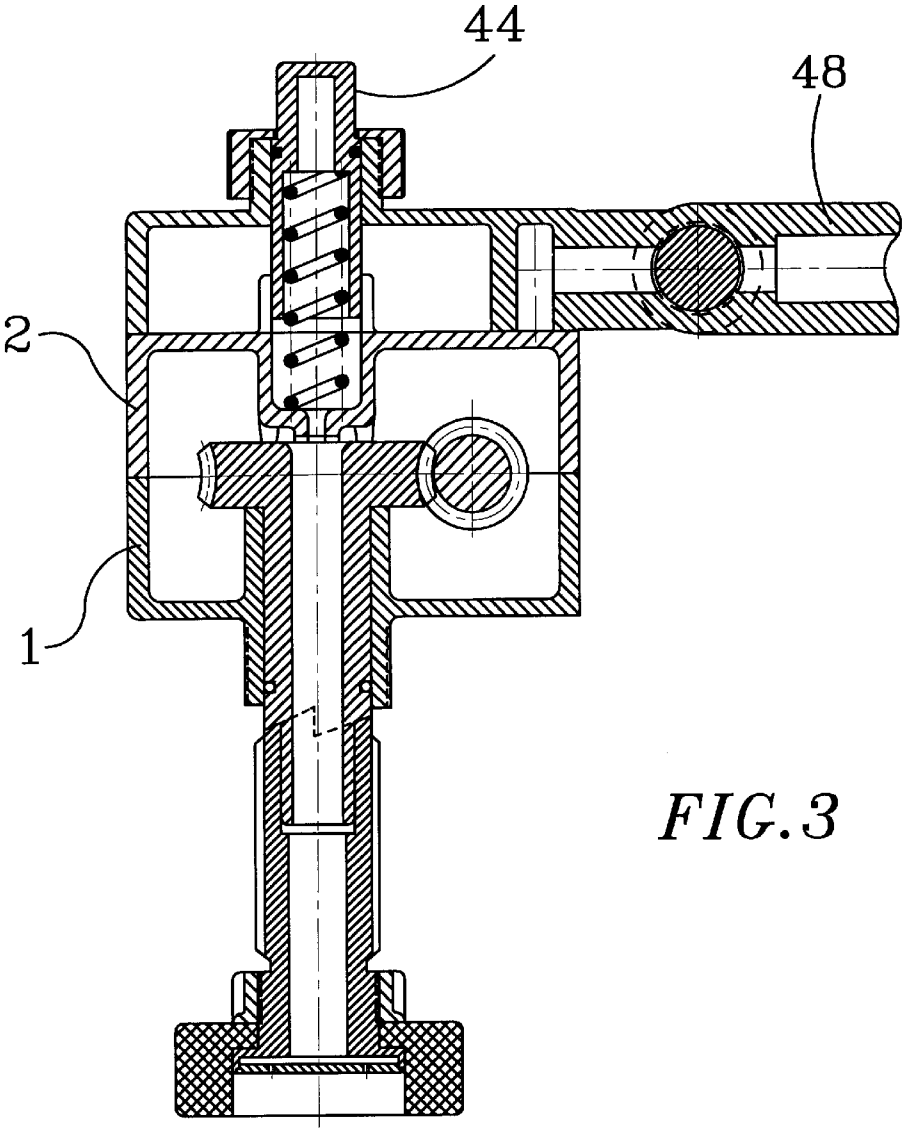
FIG. 3 is a side view of the cleaning device in accordance with the present invention in a section taken along the line 3—3 together with a working instrument formed as a pad attachment.

A hub 10 shown in detail in FIG. 3 and provided with an opening 11 is located in the lower housing part 1. The outer part of the hub has a thread 40. A hub 12 with spacing projections 13 is located in the upper housing part 2. The central part of the hub ends in a small conical opening 15. Inlet openings 16 and 17 are located in the upper region of the housing part 2 in the zone of the cylindrical chambers 4 and 5. Rotors 18 and 19 are located in the side chambers 4 and 5 and mounted on square ends 20 and 21 of a worm shaft 22 so as to form a single rotary system. The vanes of one rotor are mirror-symmetrical to the vanes of the other rotor, so that the rotors produce water streams which are directed toward one another.

The upper housing part 2 is provided outside with a hub 41 having four slots 42 and an inner opening 43. A pin 44 which is spring biased by a compression spring 45 is slidingly arranged relative to the opening 43. The upper part of the pin has a flange 46 with a sealing ring 47.

A worm gear 23 engaging with the worm shaft 22 is located in the upper housing part 1. The worm gear has a hollow axle 24 with an opening 14, ending in a mounting hub 25 with a toothed gripper 26. The axle in its lower part is provided with a groove 51 and a sealing ring 50. In the upper part, a gap 27 is formed between the hub 12 and the worm gear 23. A handle 48 is welded to an upper portion of the housing part 2. Its one end is formed as a container 28 with a threaded hub 29, while its other end has a threaded portion 30 with a thread corresponding to a nut of a hose. The container is closed by a nut 31 so as to limit the stroke of the pin 44.

An automatically closing valve 33 formed as a conical plug is mounted in the side area of the handle 48. It is arranged in a conical opening 34 and closes a water supply passage 35. The opening of the valve is performed by pressing a projecting end 36 of the valve 33. The closing of the valve is performed automatically under the action of the spring 37. The valve is sealed by a rubber ring 38 and hermetically closed by a ring washer 52.

A distributing valve 39 is located in a lower part of the handle 48 to connect the opening 16 and 17 with a water supply system, so as to provide a water supply to the rotors 18 and 19. A spraying member 49 is mountable on the threaded portion 40 of the housing part 1 to convert the device into a conventional sprayer.

Figure 4:
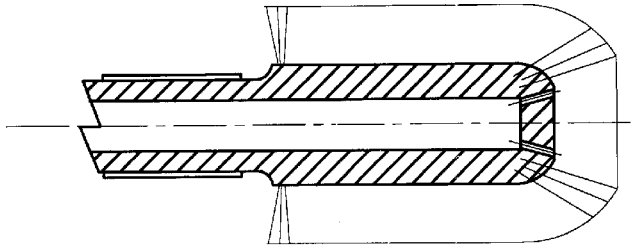
FIG. 4 is a view showing a working instrument formed as a glass brush attachment.
Figure 7:
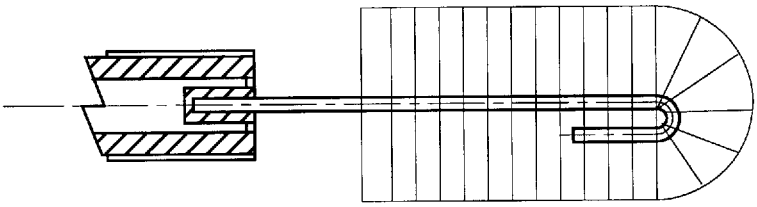
FIG. 7 is a view showing a working instrument formed as a wire brush attachment.
Figure 6:
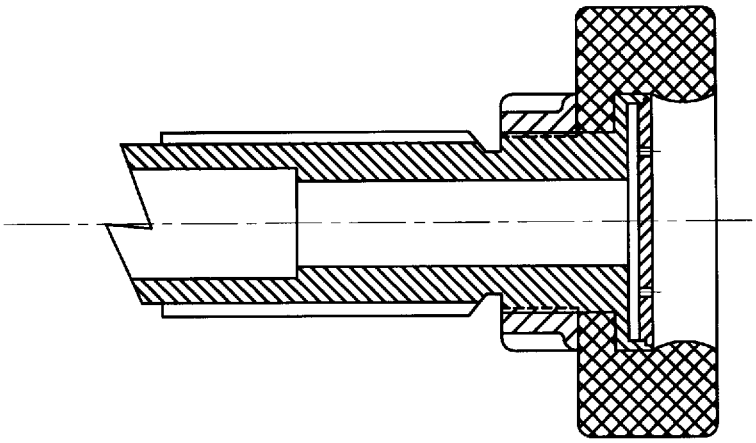
FIG. 6 is a view showing the working instrument formed as a pad attachment.
Figure 5:
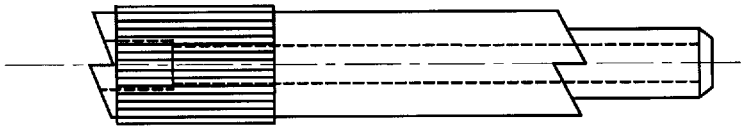
FIG. 5 is a view showing an extension for the inventive cleaning device.

As can be seen from FIG. 4, the device can be provided with a working instrument formed as a glass brush attachment with spray or without spray. An extension shown in FIG. 5 can be attached to the device, for example to extend the working element by at least three inches. Another working instrument to be attached to the device is formed as a pad attachment attachable to the device for corresponding cleaning as shown in FIG. 6. Finally, as shown in FIG. 7, a wire brush attachment can be attached to the outlet member of the device as well.

The device in accordance with the present invention operates in the following manner. The handle is attached to an outlet of a water system and water is supplied into the handle. When the valve 33 is opened by a user, water passes through the openings 16 and 17 into the chambers 4 and 5. As a result, the rotors 18 and 19 are rotated in the chambers 4 and 5 by the passing water so as to rotate the worm shaft 22 and the worm gear 23. The water is issued through the lower end of the tool in FIG. 1, and a working instrument mounted on the lower end of the worm gear 23 is rotated by the latter. A washing solution, when desired, is supplied from the container 28 by reciprocatingly moving the pin 44 to open and close the opening 43 and to thereby pump the washing solution.

It will be understood that each of the elements described above, or two or more together, may also find a useful application in other types of constructions differing from the types described above.

While the invention has been illustrated and described as embodied in cleaning device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cleaning device, comprising a housing; a turbine drive located in said housing and rotatable under the action of water flowing into said housing, said turbine drive including two rotors connected with one another so that under the action of water flowing through said housing said rotors are rotated together; said housing having two separate chambers each accommodating a respective one of said rotors and each separately receiving water so that said rotors are rotated by the waters in said chambers; transmission means for transmitting the rotation of said two rotors to an output member on which a working instrument is mountable; means for issuing water from said housing, said transmission means including a connecting element formed as a worm shaft and connecting said rotors with one another, and a worm gear engaging with said worm shaft and having a portion on which a working instrument is mountable.

2. A cleaning device as defined in claim 1, and further comprising a handle connected with said housing, said handle being hollow so as to be connected with a water source and to supply water into said housing.

3. A cleaning device as defined in claim 2; and further comprising a valve arranged in said handle so as to permit a water flow into said housing through said handle and to block water flow from said handle into said housing.

4. A cleaning device as defined in claim 2; and further comprising a rotatable working instrument which is rotated by said two rotors through a transmission means, said handle extending perpendicular to said working instrument.

5. A cleaning device as defined in claim 1; and further comprising a hollow handle connectable with a water source and connected to said housing so as to supply water from the water source into said housing, said hollow chamber being provided with distributing means formed as a passage supplying water from an interior of said handle into said chambers.

6. A cleaning device as defined in claim 1, wherein said rotors have vanes which are arranged mirror-symmetrical so that said rotors produce water streams directed toward one another.

7. A cleaning device as defined in claim 1, wherein said transmission is formed so as to convert the rotation of said two rotors in one direction into the rotation of said output member in another direction which is perpendicular to said one direction.

8. A cleaning device, comprising a housing; a turbine drive located in said housing and rotatable under the action of water flowing into said housing, said turbine drive including two rotors connected with one another so that under the action of water flowing through said housing said rotors are rotated together; means for issuing water from said housing; a handle connected with said housing, said handle being hollow so as to be connected with a water source and to supply water from the water source into said housing; and a valve arranged in said handle so as to permit a water flow into said housing through said handle and to block water flow from said handle into said housing, said valve being spring biased to a closed position in which it blocks the water flow from said handle into said housing, and is actuatable by a user so as to open and to allow the water flow from said handle into said housing.

9. A cleaning device, comprising a housing; a turbine drive located in said housing and rotatable under the action of water flowing into said housing, said turbine drive including two rotors connected with one another so that under the action of water flowing through said housing said rotors are rotated together; means for issuing water from said housing; a handle connected with said housing, said handle being hollow so as to be connected with a water source and to supply water from the water source into said housing; and a valve arranged in said handle so as to permit a water flow into said housing through said handle and to block water flow from said handle into said housing, said handle being provided with one end connectable to said water source and another end formed as a container for washing solution, said other end being attached to said housing and communicates with an interior of said housing so as to supply said washing solution into said housing.

10. A cleaning device as defined in claim 9; and further comprising means for closing automatically a flow of said washing solution from said other end of said handle into said housing under the action of a spring, and openable by a user so as to allow the flow of said washing solution from said other end of said handle into said housing.

11. A cleaning device, comprising a housing; a turbine drive located in said housing and rotatable under the action of water flowing into said housing, said turbine drive including two rotors connected with one another so that under the action of water flowing through said housing said rotors are rotated together; means for issuing water from said housing; a handle connected with said housing, said handle being hollow so as to be connected with a water source and to supply water from the water source into said housing; and transmission means for transmitting the rotation of said rotors, said transmission means including a worm shaft connecting said rotors with one another and a worm gear engaging with said worm shaft, said worm gear being hollow so as to provide a water flow from said housing outwardly, said worm gear having an end provided with engaging means for engaging a working tool mounted on the device; and a washing solution container connectable with an interior of said worm gear so that the washing solution is supplied in the interior of said worm gear and mixed with water.

12. A cleaning device, comprising a housing; a turbine drive located in said housing and rotatable under the action of water flowing into said housing, said turbine drive including two rotors connected with one another so that under the action of water flowing through said housing said rotors are rotated together; means for issuing water from said housing; a handle connected with said housing, said handle being hollow so as to be connected with a water source and to supply water from the water source into said housing, said housing having an upper housing part provided with two chambers accommodating said two rotors and also provided with a hub; transmission means for transmitting the rotation of said rotors and including a worm shaft connected with said rotors and a worm gear engaging with said worm shaft and abutting against said hub; and a washing solution supply means including a washing solution container mounted on said housing and a washing solution supply valve mounted on said container.

13. A cleaning device, comprising a housing; a turbine drive located in said housing and rotatable under the action of water flowing into said housing, said turbine drive including two rotors connected with one another so that under the action of water flowing through said housing said rotors are rotated together; means for issuing water from said housing; and a hollow handle having one end connectable to a water source and another end mounted on said housing and forming a container for accommodating a washing solution; and a pump for pumping the washing solution from said container into an interior of said housing.

* * * * *